US005364089A

United States Patent [19]

Manzer

[11] Patent Number: 5,364,089

[45] Date of Patent: Nov. 15, 1994

[54] INDIVIDUAL-SHEET STACKING APPARATUS FOR PRINTERS TO BUILD UP A STACK OF INDIVIDUAL SHEETS

[75] Inventor: Hans Manzer, Seefeld, Germany

[73] Assignee: Siemens Nixdorf Informationssysteme Aktiengesellschaft, Germany

[21] Appl. No.: 108,669

[22] PCT Filed: Feb. 5, 1992

[86] PCT No.: PCT/EP92/00256

§ 371 Date: Aug. 25, 1993

§ 102(e) Date: Aug. 25, 1993

[87] PCT Pub. No.: WO92/14668

PCT Pub. Date: Sep. 3, 1992

[30] Foreign Application Priority Data

Feb. 25, 1991 [EP] European Pat. Off. ..... 91102704.3

[51] Int. Cl.[5] ..... B65H 29/38

[52] U.S. Cl. ..... 271/177; 271/212

[58] Field of Search ..... 271/177, 178, 212, 279, 271/298, 300, 302

[56] References Cited

U.S. PATENT DOCUMENTS

| | | | |
|---|---|---|---|
| 2,859,965 | 11/1958 | Pabst et al. | 271/68 |
| 3,807,553 | 4/1974 | Billett et al. | 271/300 X |
| 3,912,253 | 10/1975 | Jarman | 271/5 |
| 4,737,045 | 4/1988 | Koefferlein | 400/613.2 |
| 5,060,025 | 10/1991 | Kummel et al. | 355/319 |

FOREIGN PATENT DOCUMENTS

| | | | |
|---|---|---|---|
| 0213429 | 4/1990 | European Pat. Off. . | |
| 2229531 | 2/1973 | Germany . | |
| 0027166 | 3/1977 | Japan | 271/212 |
| 417952 | 10/1934 | United Kingdom . | |
| WO89/08282 | 9/1989 | WIPO . | |
| WO89/08599 | 9/1989 | WIPO . | |

*Primary Examiner*—H. Grant Skaggs
*Assistant Examiner*—Carol L. Druzbick
*Attorney, Agent, or Firm*—Hill, Steadman & Simpson

[57] ABSTRACT

A stacking apparatus for printers, to build up a stack (20/1, 20/2) of individual sheets (13), includes two transport systems, designed in the form of roller cages (1/1, 1/2), for individual sheets, which systems are arranged axially parallel next to each other. Each of the roller cages (1/1, 1/2) has on its periphery roller-shaped transport elements (3) which extend in the axial direction of the roller cages (1/1, 1/2) and are spaced apart by gaps. They individually surround separate partial depositing surfaces (7/1, 7/2) of a common, inner depositing surface which crosses through both roller cages (1/1, 1/2) and is for receiving the individual sheets (10) to be stacked. By moving the roller cages (1/1, 1/2) in opposite directions, the roller cages centrally take up the individual sheets (10) to be stacked and transport them into a depositing position arranged above or below the roller cages (1/1, 1/2). At the same time, the transport elements (3), designed as transport rollers, roll on the individual sheets (10) or on packets of individual sheets. This produces a stacking apparatus for individual sheets with which the stack can be built up both from the bottom and from the top.

11 Claims, 5 Drawing Sheets

INDIVIDUAL-SHEET STACKING APPARATUS FOR PRINTERS TO BUILD UP A STACK OF INDIVIDUAL SHEETS

FIELD OF THE INVENTION

The invention relates to a stacking apparatus for printers to build up a stack of individual or single sheets.

DESCRIPTION OF THE RELATED ART

High-speed printers for printing of individual sheets, such as are known, for example, from PCT Published Application WO-89/08282, include stacking devices for depositing the printed individual sheets. In these stacking devices, which may be part of stacking containers, the printed sheet is deposited with the printed side downward and thus a stack of printed individual sheets is formed. This means that in the stack the side printed first lies at the bottom and the side printed last lies at the top. With this method of stacking, paper removal is not possible without interruption. In order nevertheless to make interruption-free removal possible with this method of stacking, the printer includes two or more independent output units with automatic switching-over. However, the problem remains that the operator cannot remove at any time the printed individual sheets in the correct sequence, but only obtains relatively large and unwieldy stacks, which he then also has to turn.

In specific applications, a plurality of print jobs are executed one after the other in continuous operation in high-speed printers, for example electro-photographic printers. A feature of a print job which is essential for the organization of the printing operation is that the quantity of printed recording carriers respectively assigned to a single print job has to be further handled as a batch. This means that recording carriers assigned to different print jobs have to be separated from one another at the output station of the printer in order for them to be separately bundled, packed or further handled in some other way. Such stacking devices for the optional laterally offset stacking of recording carriers in sheet form in an output compartment of a printer are known from PCT Published Application WO-89/08599.

There is also described, in European Published Application EP-B1 0 213 429, a paper stacking device for prefolded endless paper, in which the paper web is fed from below to a depositing table and the paper stack builds up from the bottom.

SUMMARY OF THE INVENTION

An object of the invention is to provide a stacking apparatus for printers to build up a stack of individual sheets, by which it is possible to build up a stack of individual sheets in such a way that it grows from the bottom to the top, so that the individual sheets can be removed at any time and without interrupting the printing operation.

A further aim of the invention is to design the stacking apparatus in such a way that stacks of individual sheets in which the stack grows from the top to the bottom and from the bottom to the top are optionally formed.

The stacking device is to be of a design which is simple and not prone to faults and is to permit a continuous depositing of the individual sheets.

This an other object are achieved in the case of a stacking apparatus in particular for printers, to build up a stack of individual sheets, having the following features:

two transport systems, in the form of roller cages, for individual sheets are arranged axially parallel next to each other, each of the roller cages has on its periphery roller-shaped transport elements which extend in the axial direction of the roller cages and are spaced apart by gaps;

the roller cages are coupled to a drive device, each roller cage individually surrounds one or more separate partial depositing surfaces of a common, inner depositing surface which crosses through both roller cages and is for receiving the individual sheets to be stacked;

means are provided for feeding the individual sheets to be stacked through the gaps of the transport elements to the depositing surface in such a way that they are supported on the partial depositing surfaces and by driving the roller cages in opposite directions by means of the drive device, the transport elements of the roller cages take up the individual sheets in a region of the depositing surface between the partial depositing surfaces and guide them into a depositing position above or below the roller cages.

Advantageous embodiments of the invention include providing a stacking device for individual sheets in such a way that the roller cages carry by means of their transport rollers the stack to be built up from the bottom and feed the individual sheets to be stacked to the stack from below by means of the roller cages. Another embodiment of the stacking apparatus is provided with a feeding device for individual sheets, in which the individual sheets are fed to the stack from above. As a further feature, the stacking apparatus has means for feeding the individual sheets to the depositing surface in the axial direction of the roller cages. Alternately, the stacking apparatus has means for feeding the individual sheets to the depositing surface perpendicularly to the axial direction of the roller cages.

A preferred embodiment of the stacking apparatus has stop means assigned to the depositing surface for positioning the individual sheets on the depositing surface. Means for guiding the transport elements on both sides, including a connecting link and having a coupling and driving element, connecting the transport elements to one another are provided. The transport elements are preferably rotationally movably mounted. In particular, the transport elements are rollers.

As a further feature, the stacking apparatus has a device for the optional laterally offset positioning of the individual sheets on the depositing surface.

A turning device which is arranged upstream of the stacking apparatus in the feeding direction of the individual sheets and has an intermediate compartment for receiving the fed individual sheets, and having means for taking up the individual sheets deposited in the depositing compartment and for the swiveled depositing of the individual sheets on the feeding device may be provided.

Due to the arrangement of two transport systems, which are designed in the form of roller cages, are moved in opposite directions and have a depositing surface for receiving the individual sheets to be stacked, a stacking apparatus for individual sheets with which a stack can be built up both from the bottom and from the top is produced. An individual sheet fed through gaps to the transport elements of the roller cages is taken up centrally and transported into a stacking position, which lies either underneath or above a stack to be created, depending on the direction of rotation of the roller cages. The transport elements designed as transport rollers in this case roll on the individual sheet or on packets of individual sheets. If a stack is to be built up from the bottom, the stack to be built up rests on the roller cages themselves and the stack grows from the bottom to the top in a manner easily visible for the operator and can, as desired, be carried away at any time.

According to one embodiment of the invention, it is also possible to use the stacking apparatus provided with the roller cages as a type of separating device by which, for example job by job, either a stack building up from the bottom or a stack which builds up from the top can be built up. Consequently, an assignment to separate stacks is possible.

Furthermore, in an advantageous way, the stacking apparatus may itself be assigned a device for the optional laterally offset positioning of the individual sheets or packets of sheets on the depositing surface. Consequently, it is possible with the stacking apparatus itself to achieve a job-by-job offset.

The stacking apparatus itself is insensitive to different paper thicknesses of the individual sheets. It is possible with it to stack and destack individual sheets or else bundles of sheets (packets of sheets).

A feeding of the individual sheets to the stacking apparatus may be performed both from the side, i.e. in the axial direction of the roller cages, or from the broad side, i.e. perpendicularly to the axial direction of the roller cages. It is also possible, for example depending on the format of the individual sheets, to feed the individual sheets from different sides of the roller cages.

Consequently, an extremely flexible stacking apparatus system for high-speed printers operating with individual sheets can be provided.

BRIEF DESCRIPTION OF THE DRAWINGS

Embodiments of the invention are described in more detail below by way of example and are represented in the drawings, in which.

DETAILED DESCRIPTION OF THE PREFERRED EMBODIMENTS

Figure 1:
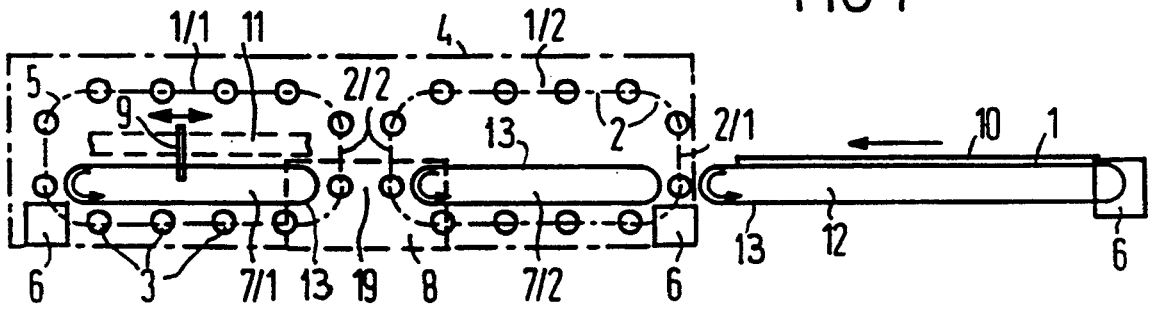
FIG. 1 shows a diagrammatic representation of the stacking apparatus with roller cages from the side.

An individual-sheet page printer, which is not shown in detail but operates on the electrophotographic principle, such as that known, for example, from PCT Published Application WO-89/08282, has a stacking apparatus for individual sheets to build up a stack of individual sheets. It includes two transport systems 1/1 and 1/2, which are designed in the form of roller cages and are arranged axially parallel next to each other. The roller cages in turn include a multiplicity of transport rollers 3, which are arranged at intervals 2 and are mounted rotationally movably in connecting link guides of side elements 4. Instead of movably mounted transport rollers, it is also possible to use rod-shaped round transport elements, which are not mounted rotationally movably, but have a surface which allows sliding, for example made of plastic or a similar material which allows sliding.

The individual transport rollers 3 are connected to a chain 5, which is in engagement with drive motors 6. Inside the roller cages is a depositing surface, which crosses through both roller cages 1/1 and 1/2 and comprises two separate partial depositing surfaces 7/1 and 7/2. The partial depositing surfaces have axially extending transport belts which are coupled so as to be driven by means of a motor 8. Instead of a single motor 8, separate drive motors which are, for example, actuated in a manner synchronized with each other can also be provided for the belts. Furthermore, there is assigned to one of the roller cages 1/1 a stop 9, Which extends over the width of the belts 7/1 and 7/2 and serves the purpose of positioning a fed individual sheet 10. In the case of the exemplary embodiment shown, the stop 9 is designed as a front stop, according to the feeding direction of the individual sheets, and it can, depending on the format and the position of the individual sheets, be adjusted horizontally by means of an adjusting device 11 in the form of a slide.

Arranged upstream of the drive device in the transporting direction of the individual sheets is a feeding device 12, which is likewise designed in the form of transport belts, feeding the individual sheets 10 to the stacking apparatus perpendicularly to the axial direction of the roller cages.

The partial depositing surfaces 7/1, 7/2, in belt form, and the feeding device include individual belts 13, (as shown more clearly in FIG. 2) tensioned by means of a common roller in each case and arranged next to one another, for transporting and for receiving the individual sheets. These individual belts 13 consist, for example, of rubber or some other material which ensures non-slipping transporting of the individual sheets.

Instead of the individual, integrally designed and rotationally movably mounted transport rollers 3, it is also possible to arrange a plurality of individual rollers on the guide spindles. The axial extent of these transport elements 3 is in this case dependent on the size of the paper formats which can be used.

In order to permit a laterally offset positioning of the individual sheets on the depositing surface or the transport belts 13, stops 15/1, 15/2 which can be actuated by means of motor-driven eccentrics 14/1, 14/2 are arranged in the region of the side elements 4. The stops include vertically extending guide plates 16, which bear against the eccentrics 14/1, 14/2 by means of tappets 17 with associated spring elements 18. After depositing of the individual sheets on the depositing surface or the partial depositing surfaces 7/1 and 7/2, it is possible by deflecting one of the two stops 15/1 or 15/2 to position the individual sheets in relation to the depositing surface.

The function of the stacking apparatus will now be explained in more detail with reference to FIGS. 3 to 6.

After depositing of the individual sheets or, as in this case, a stack of individual sheets (packet of sheets) on the transport belts 13, this small stack, assigned to a print Job, is fed to the stacking apparatus. The latter is at a standstill, a gap 2/1 between the transport rollers 3 serving as a feeding gap. The packet of sheets, comprising individual sheets, is fed through this feeding gap 2/1 to the roller cages of the stacking apparatus. The drive of the roller cages is in this case synchronized in such a way that, in the feeding position shown, there is a gap 2/2 of the roller cages 1/1 and 1/2 in the region 19 between the partial depositing surfaces 7/1 and 7/2. Consequently, the packet of sheets 10 is taken up by the transport belts 13 of the partial depositing surface 7/2 and transported through the region 19, then taken up in turn by the individual belts 13 of the roller cage 1/1 and brought up against the front stop 9 (as shown in FIG. 1). This produces the starting position shown in FIG. 3, with a positioning of the packet of sheets 10 on the depositing surface, in which the packet of sheets 10 crosses through the roller cages 1/1 and 1/2.

Figure 4:
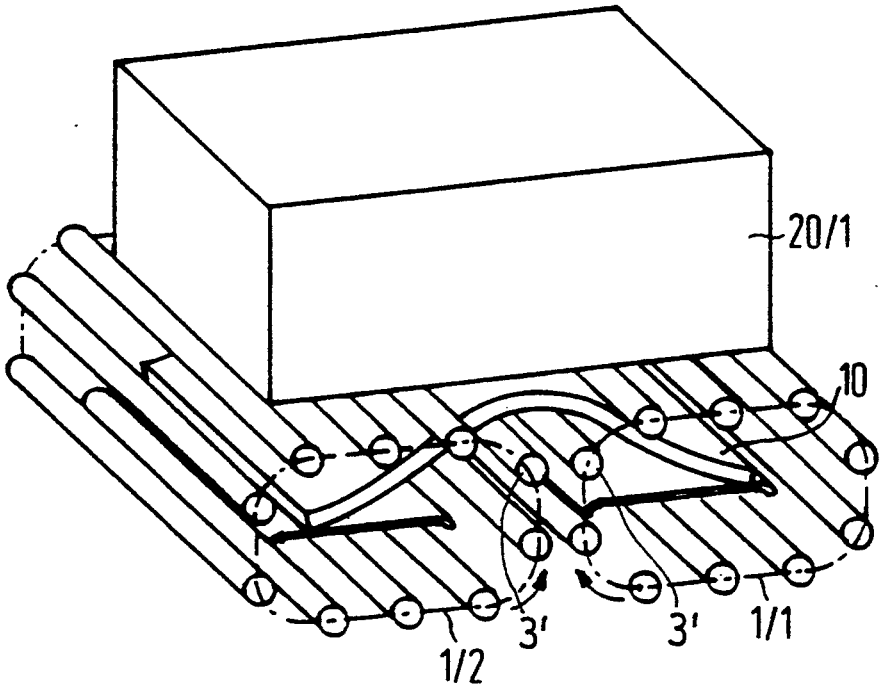
Figure 5:
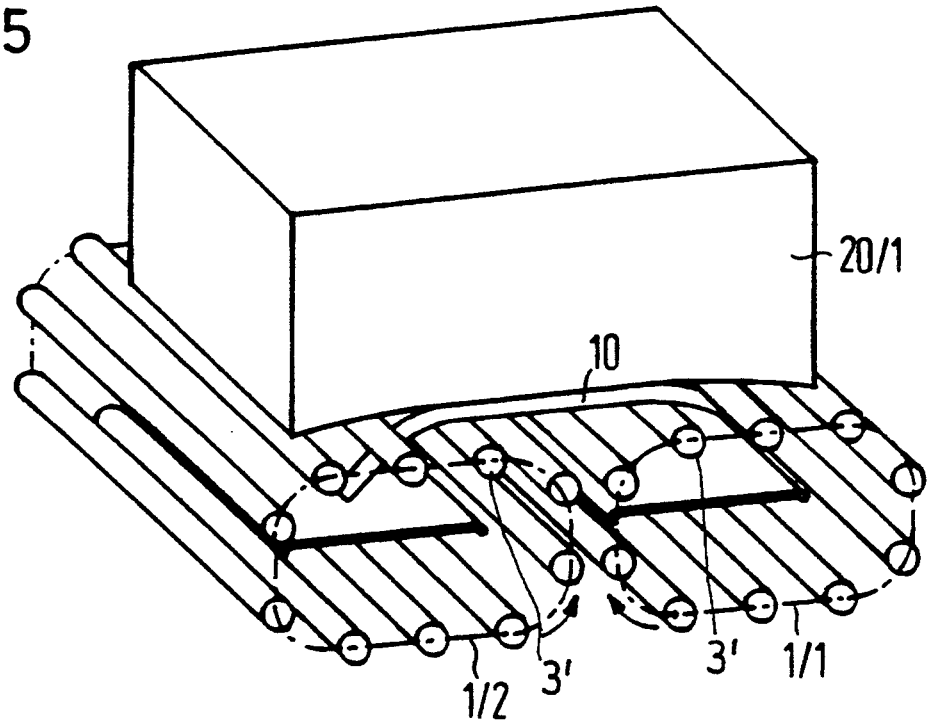

Once this feeding phase has been concluded, the actual stacking operation begins as shown in the representation of FIG. 4. The roller cages 1/1 and 1/2 are driven in opposite directions (arrows) to bring the roller 3' upward. As a result, the packet of sheets 10 is initially raised centrally by means of the transport roller 3 and specifically by the roller 3' and subsequently discharged upward in a manner corresponding to the direction of movement of the roller cages 1/1, 1/2 (arrows). As shown in the representation of FIG. 5, in this operation the transport rollers roll on the packet of sheets, so that the latter is deposited into a depositing position above the roller cages 1/1 and 1/2. Once, as shown in FIG. 5, a stack 20/1 has already formed above the transport rollers, the packet of sheets 10 is rolled from below onto this already generated stack 20/1 by the roller 3'. The inherent flexibility of the packet of sheets or of the individual sheet 10 in this case assists the depositing in the depositing position.

Figure 2:
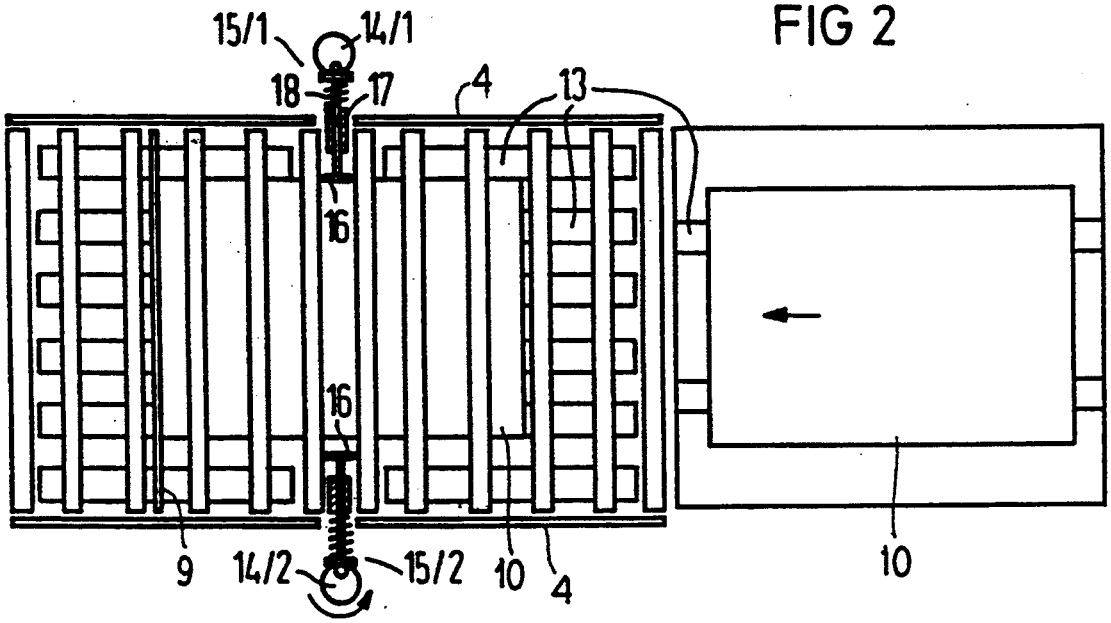
FIG. 2 shows a diagrammatic representation of the stacking apparatus with roller cages from above, with a device for the optional laterally offset positioning of the individual sheets integrated in it.
Figure 3:
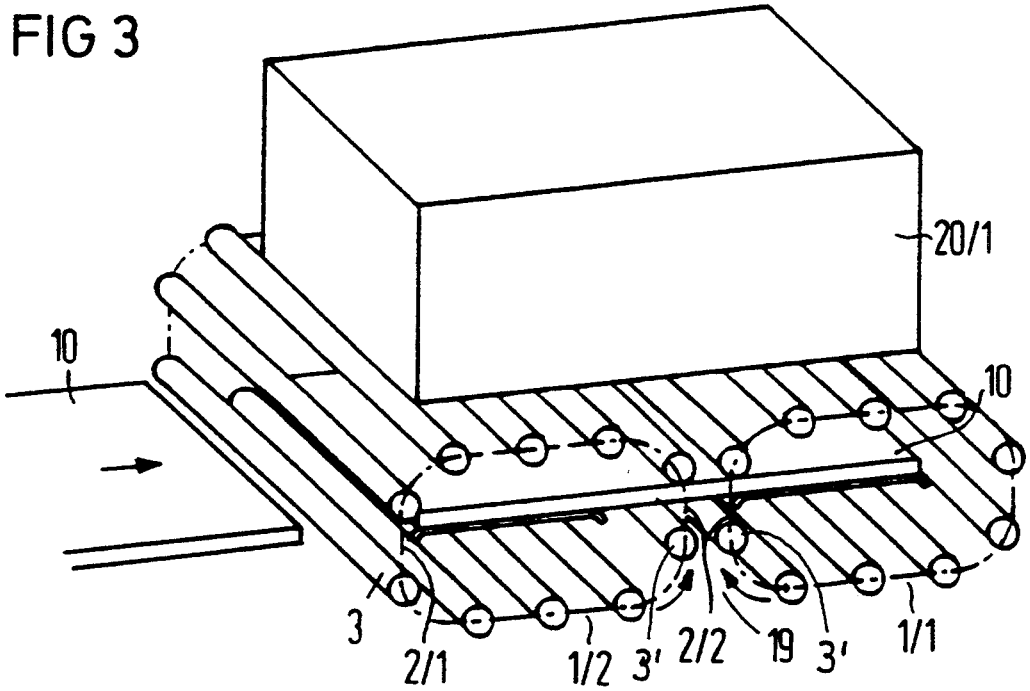
FIGS. 3 to 6 show diagrammatic representations to explain the function of the stacking apparatus.
Figure 6:
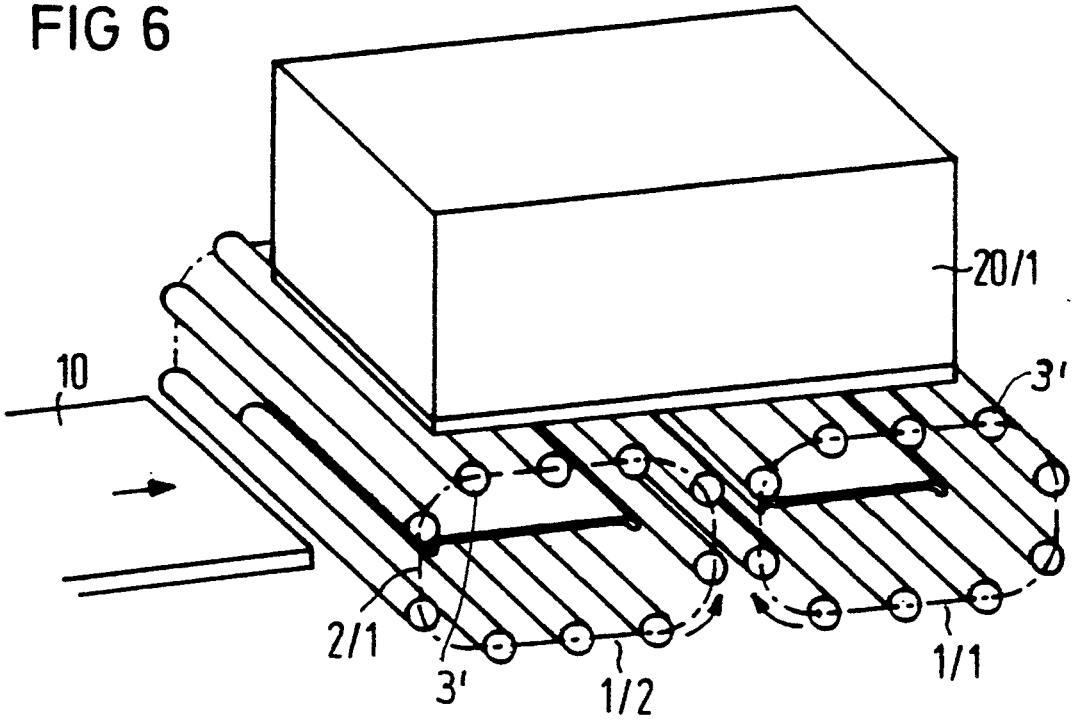

Thereafter, as shown in the representation of FIG. 6, the roller cages are again brought into a feeding position, in which they are positioned in such a way that a packet of sheets 10 can once again be introduced through the feeding gap 2/1. Consequently, the starting position of FIG. 3 is again reached. If the packets of sheets 10 are to be stacked in a job-offset manner, it is necessary—as already described—to position the following packets in relation to one another by means of the stops 15/1 and 15/2 (FIG. 2). This produces a stack 10 with laterally offset arrangement of the individual print jobs.

If the feeding of the packets of sheets 10 or of the individual sheets is synchronized mechanically or electrically with the drive of the roller cages 1/1 and 1/2, a feeding of the packets of sheets 10 with continuously moving roller cages is also possible. It must be ensured by synchronization of the drives of the partial depositing surfaces 7/1, 7/2 and of the feeding device 12 by means of the drive of the roller cages 1/1 and 1/2 that the packet of sheets 10 is fed to the partial depositing surfaces 7/1 and 7/2 when a feeding gap 2/1 of the transport rollers 3 opens ahead of the feeding device 12, seen in the transporting direction of the packets of sheets 10. Furthermore, it must be ensured that, by means of the transport systems 7/1 and 7/2 of the partial depositing surface, the packet of sheets comes into contact with the stop 9 shown in FIG. 1 before the transport rollers 3 take up the packet of sheets 10 centrally in the region 19. In order to ensure this synchronization, a corresponding actuation is necessary and also a corresponding positioning and arrangement of the individual transport rollers 3 with appropriate intervals 2 on the drive chains 5 carrying the transport rollers 3. The synchronization of the drive systems of these individual components may in this case be performed by the control of the drive device, which may, for example, be part of the control of the overall printer, or else it is ensured, for example, by a common drive arrangement by means of belts or gear wheels in the form of a mechanical coupling.

Figure 7:
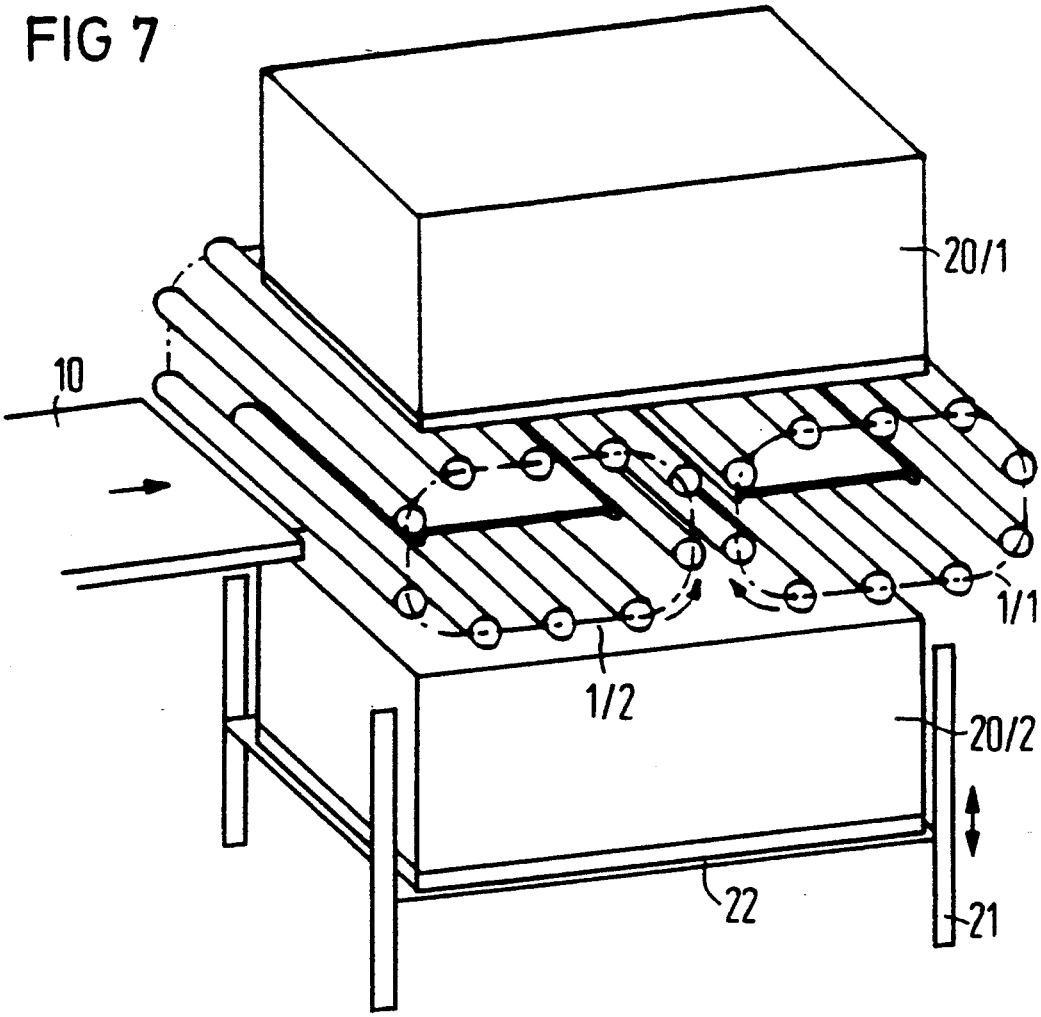
FIG. 7 shows a diagrammatic representation of the stacking apparatus for alternative depositing of the individual sheets both above and below the roller cages.

In the case of the embodiment of the stacking apparatus diagrammatically represented in FIG. 7, the optional build-up of an upper stack 20/1 from the bottom and of a lower stack 20/2 from the top is possible. For this purpose, a receiving plate 22 which can be raised and lowered in its height by means of an adjusting device 21 is arranged below the stacking apparatus with the roller cages 1/1 and 1/2. Depending on the choice of drive direction (arrow) of the roller cages 1/1 and 1/2, the individual sheet or packet of sheets 10 positioned on the partial depositing surfaces 7/1 and 7/2 is stacked upward or downward with respect to the stacking apparatus. This can be performed optionally, depending on the type and content of the fed packet of sheets 10. It is also possible to feed to the stacking apparatus a series of packets of sheets and individual sheets of different format and then perform the depositing format dependently.

Furthermore, it is possible to only use a stacking apparatus arranged underneath the stack and thus to stack the packets of sheets or the individual sheets from above in the conventional way.

Figure 8:
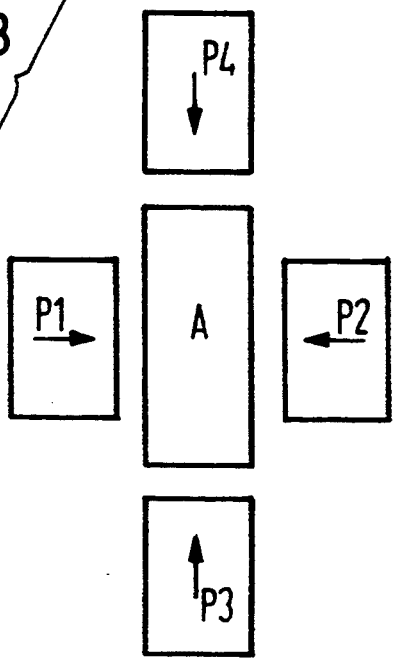
FIG. 8 shows a diagrammatic representation to explain the various possibilities of feeding the individual sheets to the stacking apparatus.

The feeding of the packets of sheets and of the individual sheets to the stacking apparatus itself can be performed in a variety of ways corresponding to FIG. 8. For instance, it is possible to feed individual sheets or the packets of sheets 10 to the stacking apparatus A from both sides in the axial direction of the roller cages 1/1 and 1/2 (feeding direction P1 and P2) or else to feed them from both sides perpendicularly to the axial direction of the roller cages 1/1 and 1/2 (feeding directions P3 and P4). A change of the feeding directions during stacking is also possible. In all cases, however, it is necessary to synchronize the feeding with the position of the roller cages, so that they are fed in the gaps 2, 2/1, 2/2 or sections of the transport rollers 3. This synchronization may be monitored, for example, by means of corresponding photoelectric scanning elements and controlled by means of the control of the printer.

Figure 9:
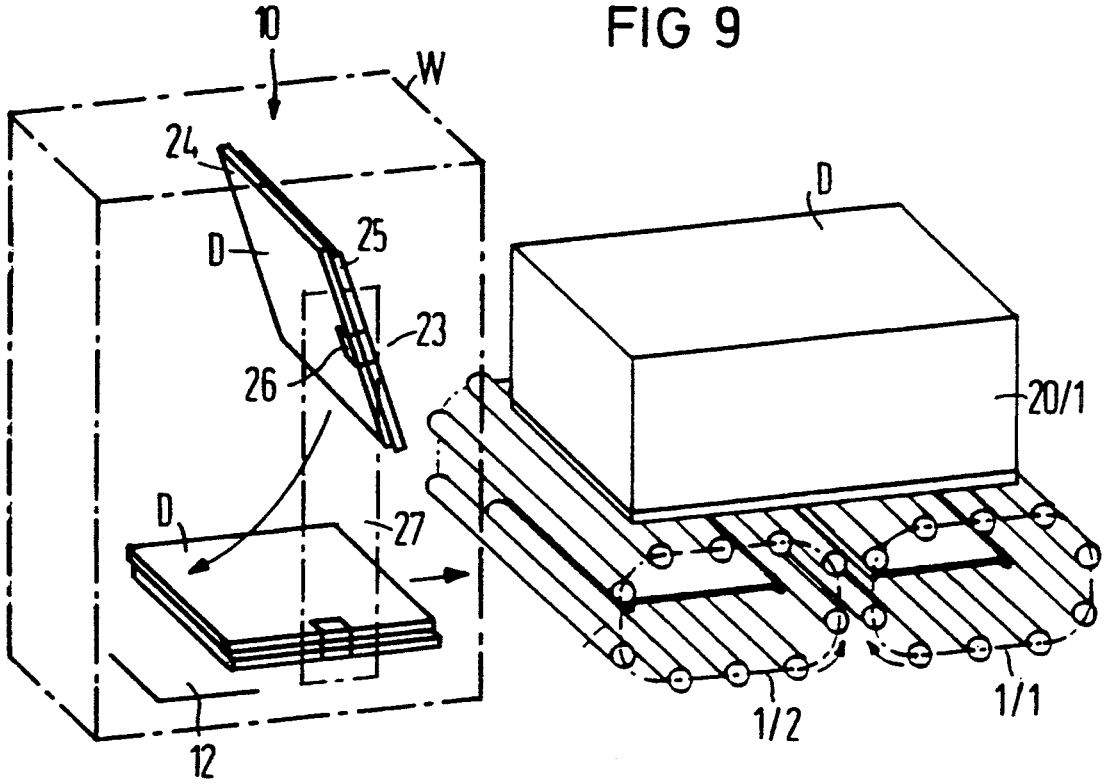
FIG. 9 shows a diagrammatic representation of the stacking apparatus with an upstream turning device for the individual sheets.

In the case of the exemplary embodiment of the stacking apparatus represented in FIG. 9, a turning device is arranged upstream of the stacking apparatus. This turning device includes a relatively steeply inclined depositing compartment 23 in the form of an intermediate compartment for receiving individual sheets fed from above in the direction of the arrow. It is assumed here that the printer feeds the individual sheets in the usual way with the printed side downward (face down). The first sheet of a Job is therefore deposited with the printed side D downward in the inclined intermediate compartment 23. The depositing of the series of individual sheets of the same Job is then performed by building up on the first sheet, likewise with the printed side D downward on this first sheet. Consequently, a first job 24 forms in a job-offset, laterally displaced position. The depositing compartment 23 is in this case assigned a corresponding device—which is not shown here for reasons of clarity—in the form of a slide or in the form of stops corresponding to the stops 15/1, 15/2 of FIG. 1. It is also possible, however, to use a device such as is described in PCT Published Application WO-89/08599. After the depositing of the first job 24, a corresponding laterally offset depositing of a next job 25 is performed in the depositing compartment 23. Depending on the design of the capacity of the depositing compartment 23, they consequently form a plurality of jobs 24 and 25, arranged one above the other, in which the printed sides D of the individual sheets face downward.

In order that the stacking apparatus can be used to form a stack in which the sheets are arranged face up in the stack, i.e. with the first side lying upward, it is necessary to turn the packet of sheets thus formed in a way corresponding to the direction of the arrow of FIG. 9 and to deposit them on the feeding device 12, here only indicated diagrammatically. For this purpose, the turning device includes a motor-driven gripping system, as customarily used in the printing industry, with lateral gripping elements 26, which are guided in guides 27 and which take up the packet of sheets in the depositing compartment 23 and deposit them with the printed sides D upward on the belts of the feeding device 12. The packet of sheets thus turned is then fed to the stacking apparatus A and stacked upward in the way described by means of the roller cages 1/1 and 1/2, and thus a stack 20/1 is formed in which the first printed page of a series of individual sheets lies at the top. Similarly, the individual Jobs are positioned according to their printing sequence from the top in the stack. Consequently, it is possible at any time and without interrupting the printing operation to carry away or to remove the packets of sheets or the Jobs to any extent desired from the built-up stack 20/1.

During the turning of the packets of sheets by means of the grippers 26 with the mechanical guides 27, the depositing compartment 23 can be filled once again with individual sheets in the way described. Consequently, a continuous turning and feeding to the stacking apparatus of the packets of sheets offset job by job is ensured and consequently continuous stacking and printing operation is ensured.

The stacking apparatus has been described in conjunction with its use in a printer. It may, however, also be used independently of a printer, for example in subsequent processing equipment, such as folding, cutting and sorting machines.

Although other modifications and changes may be suggested by those skilled in the art, it is the intention of the inventor to embody within the patent warranted hereon all changes and modifications as reasonably and properly come within the scope of his contribution to the art.

I claim:

1. A stacking apparatus to build up a stack of individual sheets, comprising:

two transport systems including roller cages, said two transport systems being operable to transport individual sheets and being arranged axially parallel next to each other, roller-shaped transport elements on a periphery of each of said roller cages and extending in an axial direction of said roller cages and spaced apart by gaps;

a drive device coupled to said roller cages, at least one separate partial depositing surface in each of said roller cages, each of said at least one separate partial depositing surfaces forming a common, inner depositing surface which crosses through said roller cages and is disposed for receiving individual sheets to be stacked;

means for feeding individual sheets to be stacked through the gaps between said roller-shaped of transport elements to said common, inner depositing surface in such a way that the individual sheets are supported on said separate partial depositing surfaces and said roller cages being drivable in opposite directions by said drive device so that said transport elements of said roller cages take up individual sheets in a region of said depositing surface between said partial depositing surfaces and guide the individual sheets into a depositing position relative to said roller cages.

2. A stacking apparatus as claimed in claim 1, further comprising:

means for supporting a stack to be built up from the bottom, said means for supporting including said transport rollers of said roller cages, said means for supporting also feeding the individual sheets to be stacked to the stack from below.

3. A stacking apparatus as claimed in claim 1, further comprising:

means for receiving a stack to be formed, said means for receiving being positioned below said stacking apparatus so that the individual sheets are fed to the stack from above.

4. A stacking apparatus as claimed in claim 1, further comprising:

means for feeding the individual sheets to said common, inner depositing surface in the axial direction of said roller cages.

5. A stacking apparatus as claimed in claim 1, further comprising:

means for feeding the individual sheets to said common, inner depositing surface perpendicularly to the axial direction of said roller cages.

6. A stacking apparatus as claimed in claim 1, further comprising:

stop means for positioning the individual sheets on said common, inner depositing surface.

7. A stacking apparatus as claimed in 1, further comprising:

means for guiding said transport elements on both sides having a coupling and driving element connecting said transport elements to one another.

8. A stacking apparatus as claimed in claim 1, wherein said transport elements are rotationally movably mounted.

9. A stacking apparatus as claimed in claim 8, wherein said transport elements comprise rollers.

10. A stacking apparatus as claimed in claim 1, further comprising:

means for laterally offset positioning of the individual sheets on the depositing surface.

11. A stacking apparatus as claimed in claim 1, further comprising:

a turning device upstream of the stacking apparatus in a feeding direction of the individual sheets having an intermediate compartment for receiving the individual sheets, and having means for taking up the individual sheets deposited in said intermediate compartment and for swiveling the individual sheets.

* * * * *